United States Patent [19]

Aitcin et al.

[11] 4,348,230

[45] Sep. 7, 1982

[54] BRIQUETTES OF SILICON AND FERROSILICON DUST

[75] Inventors: Pierre C. Aitcin; Philippe Pinsonneault; Roland Fortin, all of Sherbrooke, Canada

[73] Assignee: Universite de Sherbrooke, Sherbrooke, Canada

[21] Appl. No.: 231,476

[22] Filed: Feb. 3, 1981

[51] Int. Cl.[3] ..... C21C 7/00

[52] U.S. Cl. ..... 75/129; 75/53

[58] Field of Search ..... 75/3, 53, 129

[56] References Cited

U.S. PATENT DOCUMENTS 3,309,196 3/1967 Kaneko ..... 75/3

4,128,417 12/1978 Lung ..... 75/129

*Primary Examiner*—P. D. Rosenberg

*Attorney, Agent, or Firm*—Cushman, Darby & Cushman

[57] ABSTRACT

There is disclosed a compacted unit of metallurgical grade granular material selected from silicon and ferrosilicon comprising a compressed homogeneous mixture of a fine powder of a silicon material selected from the group consisting of silicon and ferrosilicon, said silicon material being finer than 160 μm, from 2 to about 5% by weight of the silicon material of sodium or calcium bentonite and from 2 to about 5% by weight of the silicon material of sodium or calcium lignosulfonate. The novel compacted units are useful for use in industrial processes requiring substantially pure silicon or ferrosilicon.

8 Claims, No Drawings

BRIQUETTES OF SILICON AND FERROSILICON DUST

The present invention relates to a novel compacted unit of metallurgical grade powdered silicon or ferrosilicon and to a method for its preparation.

BACKGROUND OF THE INVENTION

Silicon and ferrosilicon are produced in the form of ingots and are subjected to a crushing operation so that they are available to users in smaller size. During the crushing operation a very fine powder of silicon or ferrosilicon is formed and recovered from the filtering system. Through recent environmental regulations the amounts of silicon and ferrosilicon dusts has risen continuously thus creating a disposal problem for the manufacturers of silicon and ferrosilicon.

Attempts to find a use for such silicon and ferrosilicon powders have had little success because it must be appreciated that any agglomeration process must insure that the purity of the silicon or ferrosilicon is substantially retained. Accordingly most processes developed in the prior art have produced a product which is not equivalent in purity to the original product so that such agglomerated product can not be used instead of the pure product itself.

U.S. Pat. No. 4,128,417, Dec. 5, 1979 describes a process for the preparation of SiC and/or FeSi-containing fine materials to form metallurgically adjustable silicon bearers by binding the SiC and/or SiFe fines with a hydraulic binding agent such as cement or lime. This method produces a product containing 8–10% calcium oxide or 5,6 to 7% of calcium which amount renders it unsuitable to be used as pure silicon or ferrosilicon.

It is an object of the present invention to provide a metallurgical grade compacted unit of fine powdered silicon or ferrosilicon where the amount of impurities originally present have not been increased to a point where the product still retains the chemical qualities of the original silicon or ferrosilicon.

SUMMARY OF THE INVENTION

In accordance with the present invention there is now provided a compacted and shaped unit of metallurgical grade granular material selected from silicon and ferrosilicon comprising a compressed homogeneous mixture of a fine powder of a silicon material selected from the group consisting of silicon and ferrosilicon having a grain finer than 160 μm, sodium or calcium bentonite in an amount of from 2 to about 5% by weight of the silicon material and sodium or calcium lignosulfonate in an amount of from 2 to about 5% by weight of the silicon material.

The novel compacted and shaped unit of silicon or ferrosilicon is characterized by being adapted for packaging and transportation. The shaped unit is such that it can be readily broken up for metallurgical or chemical uses. The shaped unit is also characterized by the fact that the silicon or ferrosilicon retains all its original chemical properties and the amount of impurities of the silicon or ferrosilicon remain within the acceptable limits of the original silicon or ferrosilicon material.

DETAILED DESCRIPTION OF THE INVENTION

The compacted unit of silicon or ferrosilicon is prepared by first mixing together the silicon or ferrosilicon in fine powdered form (finer than 160 μm) with 2 to about 5% by weight of sodium or calcium bentonite, the mixing being carried out at high speed such as from 1500 to 2000 r.p.m. until a homogeneous mixture is obtained. There is then sprayed over this mixture while continuing to mix at high speed an aqueous solution of a sodium or calcium lignosulfonate, the amount of this latter compound representing from 2 to about 5% by weight of the silicon material. There is then obtained a plastic homogeneous paste which is fed to a briquetting machine where briquettes of the silicon or ferrosilicon are formed and subsequently dried.

The novel silicon or ferrosilicon briquettes obtained in accordance with the present invention are easily packaged and can be transported to other sites for use in industrial processes requiring substantially pure silicon or ferrosilicon.

The silicon or ferrosilicon powder used in accordance with the present invention is obtained as a fine powder from the crushing of pure silicon or ferrosilicon and is usually collected from special filters. The silicon or ferrosilicon powder is composed of grains finer than 160 μm and have the grain size distribution being shown in Table I:

TABLE I

DISTRIBUTION OF GRAIN SIZE OF SILICON AND FERROSILICON POWDER

| | | | |
|---|---|---|---|
| Grain size in μm | 315 | 160 | 80 |
| Cumulative % passing for silicon | 100 | 98 | 86 |
| for ferrosilicon | 100 | 95 | 27 |

The two mixing steps used in the process of the present invention should be carried out at high speed of from 1500 to 2000 r.p.m. preferably about 1700 to 1800 r.p.m. As an example of a suitable mixer there may be mentioned the Eyrich mixer R-7 ® which is adapted to operate at a high speed of 1760 r.p.m.

As far as the addition of the aqueous solution of sodium or calcium lignosulfonate is concerned this solution should be sprayed on the mixture of silicon or ferrosilicon and sodium or calcium bentonite to insure that a plastic homogeneous paste is obtained. The incorporation of the lignosulfonate solution to the mixture as such will not yield the desired plastic paste.

The present invention will be more fully understood by referring to the following Examples which are given to illustrate the invention only.

EXAMPLE 1

There is introduced in an Eyrich mixer R-7 ® 50 kg of silicon dust having a grain size of from 80 to 315 μm and 2 kg of calcium bentonite. The mixer is operated at a speed of 1760 r.p.m. for about 2 minutes whereby there is obtained an homogenous mixture. 2 Liters of a solution of sodium lignosulfonate sold under the trade mark LIGNOSOL by LIGNOSOL CHEMICALS LTD is mixed with 14.5 liters of water. The 16.5 liters of the lignosulfonate solution obtained is sprayed of the mixture of silicon and bentonite while continuing to mix at a speed of 1760 r.p.m. After two minutes of mixing there is obtained an homogeneous plastic paste which is then fed to a charcoal briquetting machine. These briquettes can readily be packaged and shipped. It has also been found that the addition of calcium bentonite has not substantially altered the chemical purity of the original silicon powder.

EXAMPLE 2

By proceeding in the same manner as in Example 1 but substituting ferrosilicon dust for the silicon dust, ferrosilicon briquettes similar to the silicon briquettes are obtained.

EXAMPLE 3

ANALYSIS

The silicon briquettes of Example 1 and ferrosilicon briquettes of Example 2 were analyzed to determine the amounts of Fe, Al, Ca and Ti present in order to compare these impurities with the limits generally requested by the specifications of the customer's dusts used in the preparation of the briquettes. Results are reported in Table II:

TABLE II

| | Acceptable Maximum impurities in % in certain industrial uses | | | |
|---|---|---|---|---|
| | Fe | Al | Ca | Ti |
| Maximum percent permissible by the specifications of the customer's for silicon powder | 1.0 | 1.5 | 0.5 | 0.5 |
| Silicon briquettes Ex. 1 | | | | |
| Run #1 | 0.64 | 0.97 | 0.40 | 0.20 |
| Run #2 | 0.63 | 1.02 | 0.35 | 0.18 |
| Maximum percent permissible by the specifications of the customer's for ferrosilicon powder | — | 2.5 | 0.5 | 0.3 |
| Ferrosilicon briquettes Ex. 2 | | | 0.32 ↓ | 0.06 ↓ |
| Run #1 | — | 2.05 | ↓ | ↓ |
| Run #2 | — | 1.97 | 0.36 | 0.07 |

It will be seen from the above analysis that the amounts of Fe, Al, Ca and Ti impurities in the silicon ferrosilicon briquettes of the present invention are below the maximum impurities permissible in pure silicon and ferrosilicon for their respective industrial uses.

We claim:

1. A compacted unit of metallurgical grade granular material selected from silicon and ferrosilicon comprising a compressed homogeneous mixture of (1) a fine powder of a silicon material selected from the group consisting of silicon and ferrosilicon, said silicon material being finer than 160 μm, (2) from 2 to about 5% based on the weight of the silicon material of sodium or calcium bentonite and (3) from 2 to about 5% based on the weight of the silicon material of sodium or calcium lignosulfonate.

2. A compacted unit of metallurgical grade silicon comprising a compressed homogeneous mixture of (4) a fine powder of silicon finer than 160 μm, (2) from 2 to about 5% based on the weight of silicon of sodium or calcium bentonite and (3) from 2 to about 5% based on the weight of the silicon of sodium or calcium lignosulfonate.

3. A compacted unit of metallurgical grade silicon according to claim 2, wherein the amount of sodium or calcium bentonite is about 4% by weight of the silicon and the amount of sodium or calcium lignosulfonate is about 4% by weight of the silicon.

4. A compacted unit of metallurgical grade ferrosilicon comprising a compressed homogeneous mixture of (1) a fine powder of ferrosilicon finer than 160 μm, (2) from 2 to about 5% based on the weight of the ferrosilicon of sodium or calcium bentonite and (3) from 2 to about 5% based on the weight of the ferrosilicon of sodium or calcium lignosulfonate.

5. A compacted unit of metallurgical grade ferrosilicon according to claim 4, wherein the amount of sodium or calcium bentonite is about 4% based on the weight of the ferrosilicon and the amount of sodium or calcium lignosulfonate is about 4% based on the weight of silicon.

6. A method for the preparation of a compacted unit of a metallurgical grade powdered material selected from the group consisting of silicon and ferrosilicon which comprises mixing at high speed (1) a fine powder of a silicon material selected from the group consisting of silicon and ferrosilicon with (2) from 2 to about 5% based on the weight of said silicon material of sodium or calcium bentonite and spraying on said mixture while continuing the high speed mixing an aqueous solution containing (3) from 2 to about 5% based on the weight of said silicon material of sodium or calcium lignosulfonate until a homogeneous plastic paste is obtained, forming briquettes from said paste and drying the same.

7. A compacted unit according to claim 1 consisting essentially of (1) silicon or ferrosilicon, (2) sodium or calcium bentonite, and (3) sodium or calcium lignosulfonate.

8. A compacted unit according to claim 7 wherein the amount of sodium or calcium bentonite is about 4% based on the weight of the silicon or ferrosilicon and the amount of sodium or calcium lignosulfonate is about 4% based on the weight of the silicon or ferrosilicon.

* * * * *